United States Patent [19]

Karvonen

[11] Patent Number: 4,964,780

[45] Date of Patent: Oct. 23, 1990

[54] EXTENDIBLE BOOM FORKLIFT WITH LEVEL REACH CONTROL

[76] Inventor: Robert Karvonen, R.R. #1, Box 203A, Pelkie, Mich. 49958

[21] Appl. No.: 142,548

[22] Filed: Jan. 11, 1988

[51] Int. Cl.[5] ..... B66C 23/00

[52] U.S. Cl. ..... 414/728; 414/718

[58] Field of Search ..... 414/718, 728, 742

[56] References Cited

U.S. PATENT DOCUMENTS

| | | | |
|---|---|---|---|
| 2,887,236 | 5/1959 | Mindrum | 414/728 X |
| 3,087,636 | 4/1963 | Weaver | 414/728 X |
| 3,178,040 | 4/1965 | Nelson | 414/728 |
| 3,178,046 | 4/1965 | Lull . | |
| 3,184,086 | 5/1965 | Lull . | |
| 3,198,359 | 8/1965 | Lull . | |
| 3,327,879 | 6/1967 | Lull . | |
| 3,543,910 | 12/1970 | Devol et al. | 414/728 |
| 3,840,128 | 10/1974 | Swoboda, Jr. et al. | 414/728 |
| 4,147,263 | 4/1979 | Frederick et al. . | |
| 4,162,873 | 7/1979 | Smith, Jr. | 414/718 |
| 4,791,549 | 12/1988 | Heiser et al. | 414/728 X |

OTHER PUBLICATIONS

Lull 644 Highlander II sales brochure.
Pettibone Model B-68 Extendo sales brochure.
Pettibone Extendo Model C8000 sales brochure.
Pettibone Extendo 88 sales brochure.
Pettibone Model SB-68 Extendo sales brochure.
Sellick Maxi-Reach sales brochure.
Hyster Reach Carriage Attachment sales brochure.

*Primary Examiner*—Frank E. Werner
*Assistant Examiner*—William M. Hienz

[57] ABSTRACT

A direction controlling mechanism for an extendible boom forklift or the like controls the direction of movement of a predetermined point, such as a fork section connected to the distal end of the boom sections, relative to the forklift frame during retraction or extension of the boom members. The direction controlling mechanism is disposed between the proximal end of the boom sections and the main frame section of the forklift. The direction controlling mechanism includes an extendible member disposed between an upper shaft provided on the boom sections and a lower shaft provided on the vehicle frame. The length of the extendible member can be fixed during retraction or extension of the booms, and a driving mechanism moves the fixed length extendible member along the upper and lower shafts. Such movement tends to compress or elongate the extendible member, and the tendency of the extendible member to compress or elongate is sensed by a sensing mechanism and translated into hydraulic fluid pressure, which is directed to the appropriate side of the boom lift cylinders so as to maintain the load carried by the boom at a constant predetermined direction of movement during extension or retraction of the boom members. In a preferred embodiment, the load is maintained at a constant elevation relative to the forklift frame.

21 Claims, 7 Drawing Sheets

10
12
14
16
18
20
22
24
26
28
30
32
34
36
37
38
40
42
44
45
160

EXTENDIBLE BOOM FORKLIFT WITH LEVEL REACH CONTROL

BACKGROUND AND SUMMARY

This invention relates to a load lifting apparatus, and more particularly to an extendible boom forklift.

An extendible boom forklift generally includes one or more extendible and retractable boom sections with a fork section connected at the distal end of the boom sections and disposed at an angle relative to the boom sections. The boom sections are operable to move a load supported by the fork section toward and away from the vehicle to which the boom sections are mounted. During extension or retraction of the boom section, the fork section moves in a direction generally parallel to the axis of the booms. In most field applications, the axis of the booms is disposed at an angle to the axis of the vehicle frame when it is desired to extend or retract the booms to move a load. Thus, during extension or retraction of the booms, the load supported by the fork section moves at an angle relative to the vehicle frame.

In many field applications, it is desirable to move the load at a constant elevation relative to the vehicle frame when entering, positioning or withdrawing the fork relative to the load. With present boom control systems, it is necessary to simultaneously manipulate two separate control levers to maintain the fork at a constant elevation relative to the vehicle frame during extension or retraction of the booms. That is, while the operator is actuating the boom extension or retraction mechanism, the boom lift mechanism must simultaneously be actuated in order to maintain the altitude of the fork. Such simultaneous manipulation of separate control levers is difficult to accomplish and, even when the operator is skilled, results in jerky fork movements caused by the necessary intermittent actuation of the lift mechanism. When the load is raised, such jerky movements can greatly affect the stability of the machine.

Additionally, with or without a separate level extension mechanism, it is often difficult for an operator to see adequately when the booms are raised so as to even attempt to provide level movement of the load.

It is known to provide a separate mechanism at the fork end of the extendible boom members which provides a limited amount of level traverse of the forks. However, such a mechanism must be designed to carry the rated load and is therefore bulky and heavy. With its location at the distal end of the boom members, this type of mechanism requires substantial counterbalancing in order to prevent tipping of the forklift. It is also known to construct a forklift so that the entire mechanism is movable along rails mounted to the vehicle chassis to provide level traverse of the forks. Such a construction provides a limited amount of level travel, and, by its nature, creates a shifting center of gravity of the machine during such movement. Counterweights or outriggers are generally required to balance the machine.

It is an object of the present invention to alleviate the above-noted problems in extending or retracting the booms of an extendible boom forklift or the like while maintaining the fork elevation during traverse The invention provides a single control which allows the fork section to maintain a constant elevation relative to the frame of the vehicle during extension or retraction of the booms, thus eliminating the need to jockey two separate controls to achieve such level extension or retraction, and provides a control mechanism which is not part of the load carrying mechanism. In accordance with the invention, an extendible boom forklift or the like having one or more extendible boom members mounted thereto, with a fork section or the like connected to the distal boom member and disposed at an angle thereto, is provided with direction controlling means for controlling the direction of movement of a predetermined point on the boom sections, such as the fork section or the like, relative to the vehicle frame during extension and retraction of the boom members. In one embodiment, the direction controlling means is disposed between the vehicle frame and the proximal end of the boom members, and maintains the fork section at a constant elevation relative to the vehicle frame during extension and retraction of the boom members. The direction controlling means includes an upper stationary element, such as an upper shaft, mounted generally parallel to the axis of the boom members at the proximal end of the boom members, and a lower stationary element, such as a lower shaft, mounted substantially parallel to the vehicle frame. A control means is operative between the upper and lower shafts for maintaining the elevation of the distal end of the boom members relative to the vehicle frame during retraction or extension of the boom members. In one embodiment, the control means operative between the upper and lower shafts includes an extendible member slidably mounted at its ends to the upper and lower shafts, with the extendible member including an extension portion and a stationary portion. A clamping means is provided for clamping the extension portion of the extendible member during retraction and extension of the one or more boom members to provide a relatively fixed length for the extendible member. A drive means is provided for moving the extendible member along the upper and lower shafts in a direction substantially parallel to the frame axis during extension or retraction of the boom members in an amount proportional to the extension or retraction of the boom members. In this manner, when the upper shaft is disposed at an angle relative to the lower shaft, the movement of the extendible member along the upper and lower shafts tends to compress or elongate the extendible member. Adjustment means is provided responsive to the tendency of the extendible member to compress or elongate. The adjustment means adjusts the angle between the upper shaft and lower shaft, and therefore between the boom members and the vehicle frame, during extension or retraction of the boom members. Such adjustment of the angle between the boom members and the vehicle frame maintains the fixed length of the extendible member, and thereby the constant elevation of the fork section relative to the vehicle frame during extension or retraction.

A novel mechanism is employed for clamping the extension portion of the extendible member for fixing the length of the extendible member during extension or retraction of the boom members. The clamping mechanism generally comprises a housing mounted to the stationary member and accommodating passage of the extension member therethrough, with a sleeve disposed within the housing and also having a passage therethrough. The sleeve has an inner surface in close proximity with the extension member. The sleeve includes a relatively thin walled portion about at least a portion of the inner surface in close proximity with the extension member. A fluid passage is disposed adjacent the thin walled portion of the sleeve, and is adapted to receive fluid under sufficient pressure to deform the thin walled portion of the sleeve so as to cause the inner surface of the sleeve to frictionally engage the extension member. Such frictional engagement of the extension member by the sleeve prevents relative movement between the stationary member and the extension member. A small amount of movement of the housing is allowed so that, during extension or retraction of the boom members, the housing moves a small amount relative to the stationary member so as to indicate the tendency of the extendible member to elongate or compress during its movement along the upper and lower shafts by the drive means during extension or retraction of the boom members.

The adjustment means includes a novel mechanism for sensing the tendency of the extendible member to compress or elongate by sensing the small amount of movement allowed in the housing during extension or retraction of the boom members, and to adjust the angle between the upper and lower shafts in response to such movement. Broadly speaking, the mechanism translates a linear movement into proportional fluid pressure. The mechanism includes a sensing means for detecting a linear movement, such as that of the housing of the clamping mechanism, and a control means proportionally responsive to the sensing means for adjusting the angle between the upper and lower shafts. The control means generally includes a valve for placement in a hydraulic circuit, and the movements of the housing are compensated for by the valve directing fluid pressure to hydraulic cylinders connected between the vehicle frame and the boom members. The amount of extension of the hydraulic cylinders is adjusted responsive to movement of the housing of the clamping mechanism, to adjust the angle between the boom members and the vehicle frame to maintain the fork section at a constant elevation during extension or retraction of the boom members. In one embodiment, a sensing mechanism is interconnected with the extension portion of the extendible member through the housing of the clamping mechanism, and includes an actuator for actuating the control valve according to the direction and magnitude of movement of the housing portion of the clamping mechanism. The actuator may comprise a pivotable rocker arm sensitive to movements of the housing portion of the clamping mechanism, with end portions of the rocker arm movable toward and away from the control valve according to movements of the housing portion of the clamping mechanism. Plungers provided on the control valve are selectively actuated by the end portions of the rocker arm so as to control retraction and extension of the hydraulic cylinders in response to movement of the extension portion of the extendible member.

In one embodiment, the drive means for moving the extendible member along the upper and lower shafts includes an axially extending toothed rack interconnected with a rotatable gear. The gear rotates responsive to retraction and extension of the boom members in an amount proportional to such extension or retraction. The rack is interconnected with an upper slide provided on the upper shaft, and the extendible member is connected to the upper slide. Movement of the toothed rack thus causes movement of the upper slide and thereby movement of the extendible member which moves the lower slide while maintaining the extendible member 90° to the lower shaft.

A method is also disclosed for controlling the direction of movement of a predetermined point on one or more axially extending segments relative to a base, generally in accordance with the above-discussed features.

The above features of the invention provide an extendible boom forklift which is simple to operate while allowing the operator to maintain the load level and the elevation constant relative to the vehicle frame during retraction or extension of the boom sections. The direction controlling mechanism is relatively simple in theory and operation, and can be easily incorporated into the components of an extendible boom forklift or similar apparatus. An inherent advantage of the invention is that it directs the movement of the load, and is not required to support or carry the load in and of itself. The system does not require counterweights or other such balancing of the machine.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figures 1, 2:
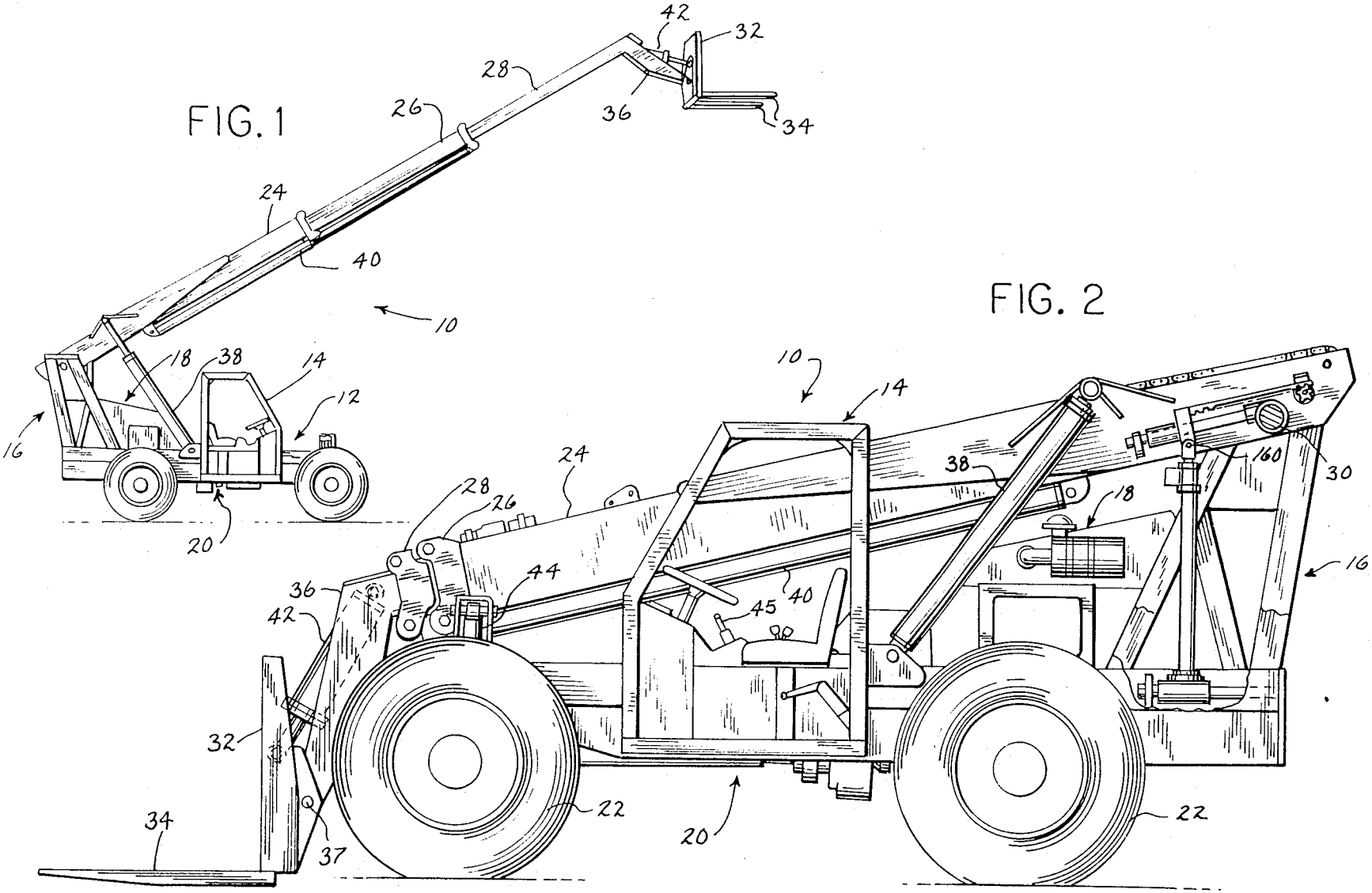
FIG. 1 is a side elevation view of an extendible boom forklift constructed according to the invention, with the booms in a raised and extended position.
FIG. 2 is a view similar to FIG. 1, showing the booms in a lowered and retracted position.

With reference to FIG. 1, an extendible boom forklift 10 generally includes a main frame assembly 12 including a canopy section 14 and rear frame section 16. A suitable propulsion means, such as an internal combustion engine designated generally at 18, is mounted to main frame assembly 12. A suitable power train mechanism, parts of which are shown generally at 20, is interconnected with engine 18 to drive forklift 10 by means of wheels 22 connected thereto, as is well known.

A series of boom members, including a large boom 24, a middle boom 26, and a small boom 28, are connected at the upper end of rear frame section 16 of main frame assembly 12 at a boom pivot pin 30 extending through the proximal end of large boom 24. A fork assembly, including a fork frame 32 and a pair of fork tines 34, are pivotably mounted at the distal end of small boom 28 by means of a connector portion 36 and a fork pivot pin 37. Connector portion 36 is disposed generally at an angle to the axis of the boom sections 24, 26 and 28.

A series of hydraulic cylinders control the movement of the various components of extension boom forklift 10. A pair of lift cylinders, one of which is shown at 38, are provided between main frame assembly 12 and the rear portion of large boom 24. Lift cylinder 38 pivots the boom sections about boom pivot pin 30 to control the angle of the boom sections relative to main frame assembly 12, and thereby the elevation of fork tines 34. A boom cylinder 40 is connected at one end to the rear portion of large boom 24, and at the other end to the front portion of middle boom 26. The extension and retraction of boom cylinder 40 controls the extension and retraction of booms 24, 26 and 28, and thereby the horizontal position of fork tines 34 relative to main frame section 12. A tilt cylinder 42 is provided between fork frame 32 and the end of small boom section 28 from which connector portion 36 extends, to control the angle of disposition of fork tines 34. A pair of sway cylinders, one of which is shown at 44, are provided at the front of main frame assembly 12 adjacent the front wheels to control the orientation of main frame assembly 12 relative to the front wheels. Sway cylinders 44 are provided for maintaining the load level when the vehicle is out of level across its width, such as during operation across the face of an incline.

Canopy section 14 houses the operator's compartment. A single joy stick control lever 45 is provided for controlling the lift and extension/retraction of the boom sections, and the tilt of the fork, as will be explained.

Tilt cylinder 42 and lift cylinder 38 are connected in series, as will later be explained in more detail. In this manner, extension of lift cylinders 38 provides automatic extension of tilt cylinder 42 so that fork tines 34 remain level. Similarly, tilt cylinder 42 retracts during retraction of lift cylinders 38 to maintain fork tines 34 level.

Figure 3:
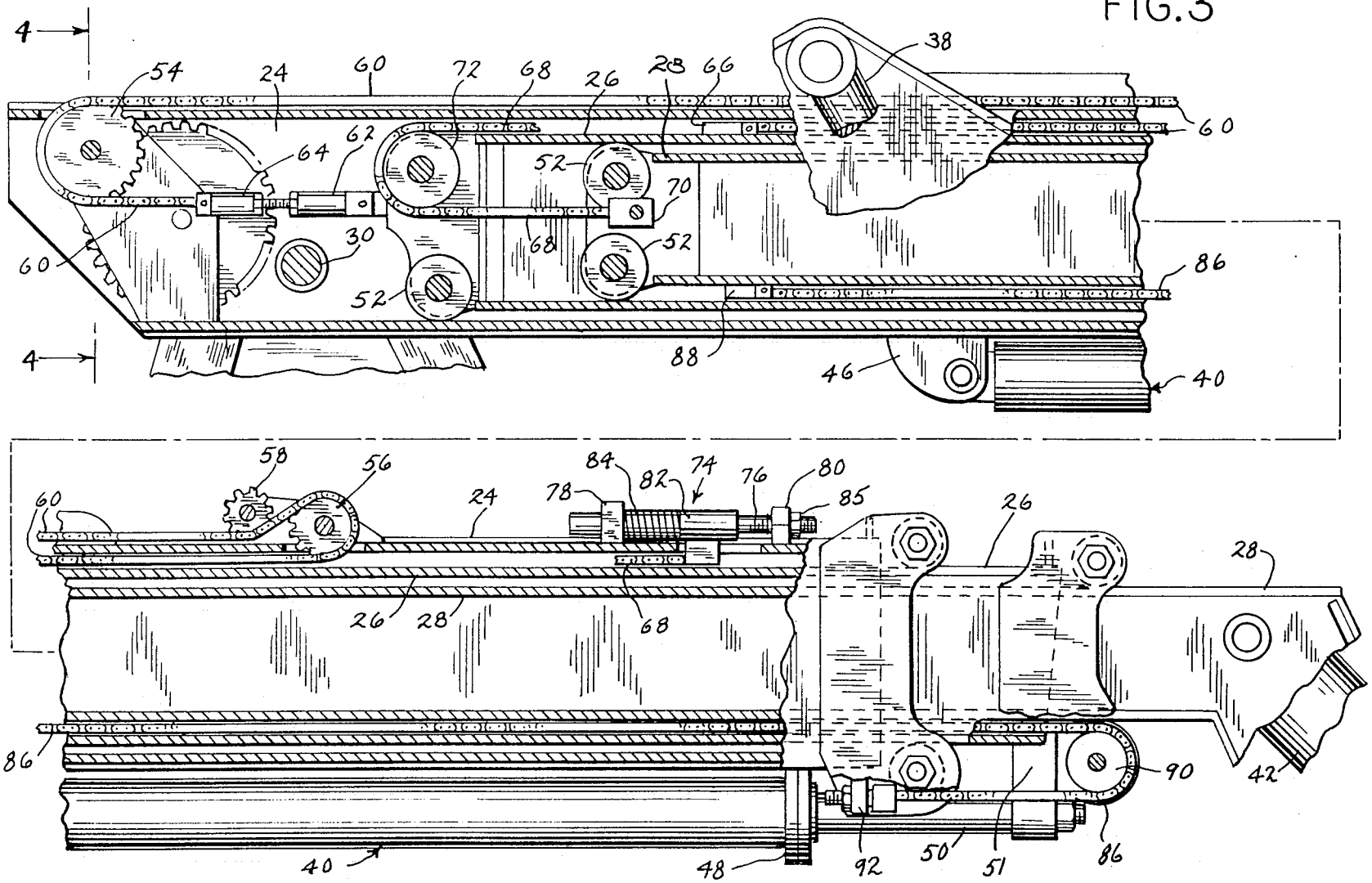
FIG. 3 is a detailed sectional view showing the mechanism for extending and retracting the boom members.

FIG. 3 illustrates the extension and retraction system for the boom sections 24, 26 and 28. As noted above, boom cylinder 40 is operative to extend and retract the boom members relative to pivot pin 30. The housing portion of boom cylinder 40 is mounted at its ends to the underside of large boom section 24 through a rear mounting bracket 46 and a front support 48. The rod portion of cylinder 40, shown at 50, is mounted to the front end of middle boom section 26 through a bracket 51. Accordingly, extension and retraction of rod portion 50 of boom cylinder 40 causes middle boom section 26 to extend and retract relative to large boom section 24. A series of rear rollers, designated generally at 52, are mounted to the rear ends of boom sections 26 and 28 to provide smooth movement of sections 26 and 28 during extension and retraction. A rear roller 52 is also disposed on a shaft common with a sheave 72. Front rollers are also provided at the front ends of large boom section 24 and middle boom section 26.

A copy sprocket 54 is mounted at the rear end of large boom section 24, and a front sprocket 56 is mounted adjacent the front end of large boom section 24. An idler sprocket 58 is mounted adjacent front sprocket 56 between sprockets 54 and 56. A copy chain 60 is connected at one end to the rear end of middle boom section 26 by means of a spring assembly 62 and a yoke 64. Copy chain 60 extends around copy sprocket 54, from copy sprocket 54 around front sprocket 56, and is connected at its other end to a copy chain anchor 66 mounted on the top of middle boom section 26. With this mechanism, copy sprocket 54 is driven in an amount proportional to the extension or retraction of middle boom section 26 relative to large boom section 24, to drive the drive mechanism for the direction controlling mechanism, as will be explained.

A series of chains and sprockets are provided to extend and retract small boom section 28 during extension and retraction of middle boom section 26 by boom cylinder 40. A retraction chain 68 is anchored at one end to the rear portion of small boom section 28 at an anchor 70. Retraction chain 68 loops around a rear retraction sheave 72 mounted to the rear end of middle boom section 26, and extends along the length of middle boom section 26 to a spring anchor assembly 74 provided on the top of large boom section 24. Anchor assembly 74 includes a rod 76 mounted between a pair of supports 78, 80 affixed to the top of large boom section 24. An anchor portion 82 is slidably mounted to rod 76, to which an end of retraction chain 68 is connected. A spring 84 is disposed between anchor portion 82 and left support 78, and is engaged about a shoulder portion formed on shaft 76 (not shown) adjacent left support 78. A nut 85 is provided on a threaded end of rod 76 to adjust the tension of spring 84. Spring anchor assembly 74 provides tension on retraction chain 68.

A pair of extension chains, shown at 86, are connected at one end adjacent the rear end of small boom section 28 to two anchors 88 connected to the bottom of small boom section 28. Extension chains 86 are also tensioned by spring anchor assembly 74. Chains 86 extend along substantially the entire length of small boom section 28, and loop around a front extension sheave 90 mounted to the front of middle boom section 26. The other end of extension chains 86 are connected to the underside of large boom section 24 at chain anchors 92.

With the above described assembly, a two to one extension and retraction of the boom sections is provided during extension and retraction of rod portion 50 of boom cylinder 40. When rod portion 50 is extended so as to cause middle boom section 26 to extend relative to large boom section 24, extension chain 86 simultaneously extends small boom section 28 the same amount. When rod portion 50 is retracted so as to move middle boom section 26 toward large boom section 24, retraction chain 68 simultaneously retracts small boom section 28 within middle boom section 26 the same amount. The described chain and sheave assembly provides smooth and efficient extension and retraction of the boom sections relative to each other during extension and retraction of boom cylinder 40.

Figure 4:
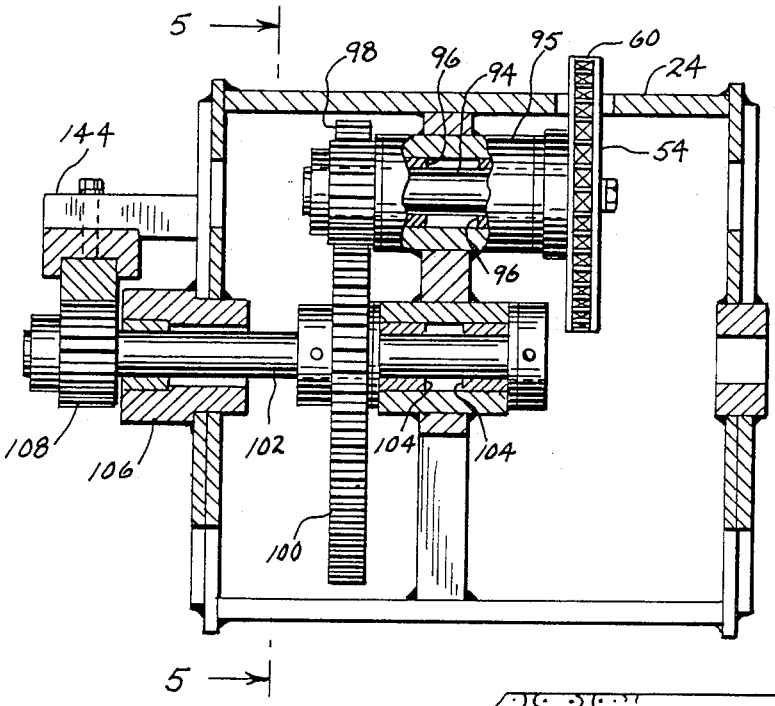
FIG. 4 is a sectional view taken generally along line 4—4 of FIG. 3.
Figure 5:
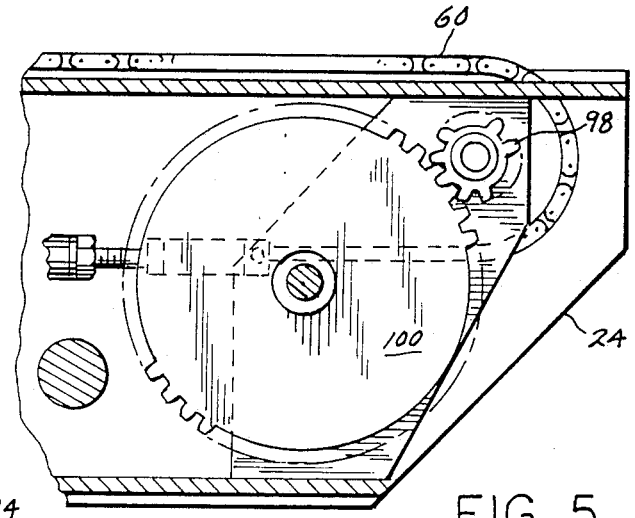
FIG. 5 is a partial sectional view taken generally along line 5—5 of FIG. 4.

As noted, during extension and retraction of the boom sections by boom cylinder 40, copy chain 60 rotates copy sprocket 54. With reference to FIG. 4, copy sprocket 54 is connected via a shaft 94 through a sleeve 95 housing a pair of bearing assemblies 96 to a gear 98, which is interconnected with a gear 100. Gear 100 is mounted to a shaft 102 extending between a pair of bearings 104 and an outboard bearing 106. A drive gear 108 is connected to shaft 102 at its end extending from bearing assembly 106. Through the reduction provided by gears 98 and 100, copy chain sprocket 54 drives drive gear 108 in an amount proportional to the extension and retraction of the boom sections along their axes.

Figure 6:
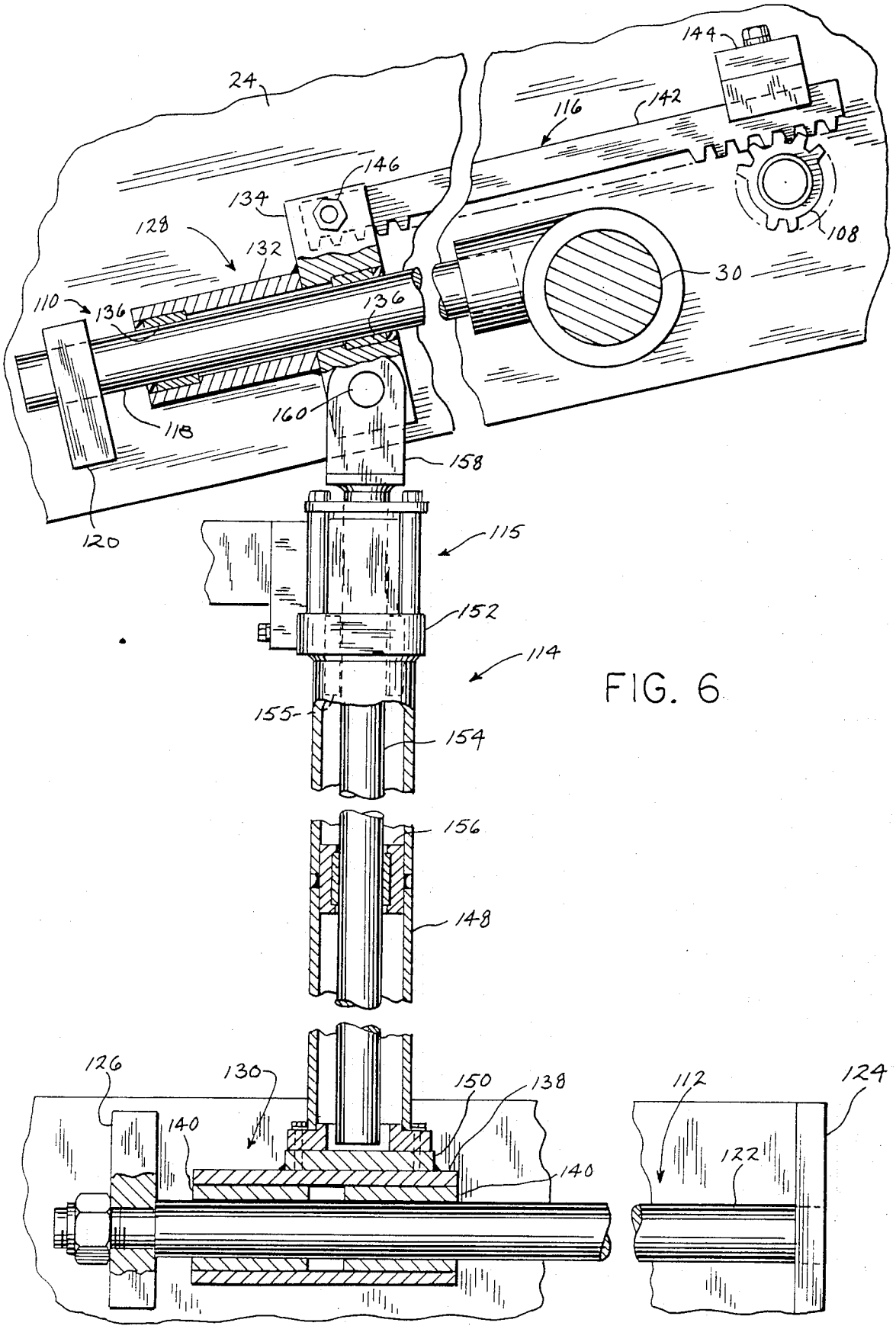
FIG. 6 is a side elevation view, partially in section, of the direction controlling mechanism of the present invention.
Figure 7:
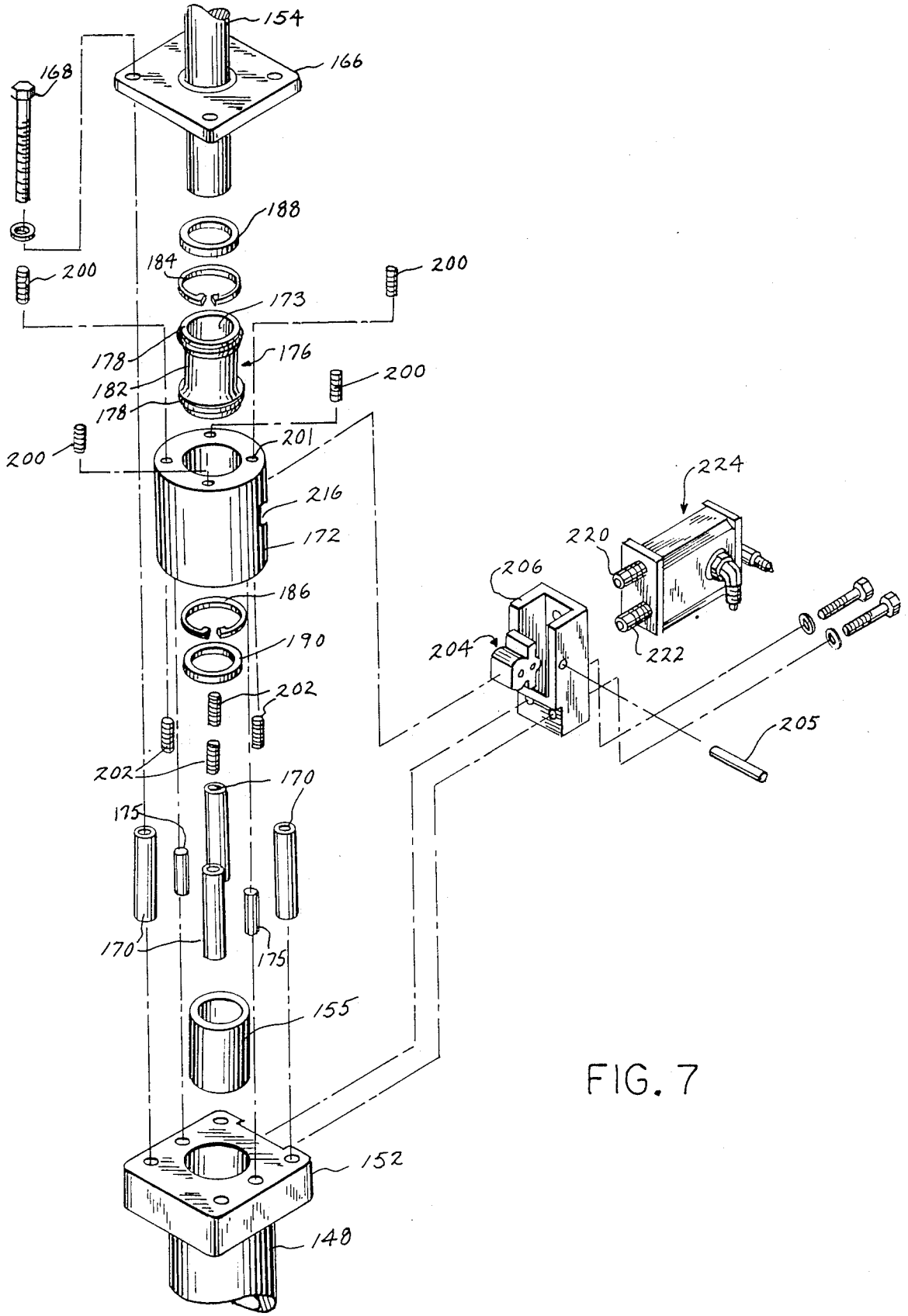
FIG. 7 is an exploded perspective view showing the clamping mechanism and the hydraulic level control mechanism of the direction controlling mechanism of the present invention.

With reference to FIG. 6, the direction controlling mechanism for controlling the direction of fork tines 34 generally includes an upper mount 110, a lower mount 112, an extendible member 114 to which a clamping mechanism 115 is connected, and a drive mechanism 116. In accordance with the preferred embodiment of the invention, the direction controlling mechanism maintains fork tines 34 at a constant elevation relative to main frame assembly 12 during retraction or extension of the boom sections.

Upper mount 110 generally includes a shaft 118 connected at its rightward end to the housing for boom pivot pin 30, and at its leftward end to a shaft support bracket 120 connected to large boom section 24. Shaft 118 is disposed generally parallel to the axis of boom sections 24, 26 and 28.

Lower mount 112 includes a shaft 122 connected at its rightward end to a plate 124 provided at the rear end of main frame assembly 12, and at its leftward end to a shaft support bracket 126 also connected to main frame assembly 12. Shaft 122 extends in a direction substantially parallel to the axis of the lower horizontal portion of main frame assembly 12.

Extendible member 114 is disposed between upper shaft 118 and lower shaft 122, and is connected to the respective shafts by means of an upper slide member 128 and a lower slide member 130.

Upper slide 128 includes a sleeve 132 welded at one end to a bar 134. A passage is provided throughout sleeve 132 and bar 134 for accommodating shaft 118 therethrough. Linear bearings 136 are mounted within the passage through sleeve 132 and bar 134 for providing smooth movement of slide 128 along upper shaft 118.

Lower slide member 130 includes a sleeve 138 having a passage for accommodating lower shaft 122 therethrough. Linear bearings 140 are mounted within the passage through sleeve 138, to provide smooth movement of lower slide 130 along lower shaft 122.

Drive mechanism 116 generally includes a toothed rack 142 provided between drive gear 108 and a stationary guide 144. Rack 142 is connected at its leftward end to bar 134 by a nut and bolt assembly, shown generally at 146. During extension or retraction of the boom sections, drive gear 108 is driven as described above. Rotation of drive gear 108 causes toothed rack 142 to move leftwardly and rightwardly in an amount proportional to the extension or retraction of the boom members. Movement of rack 142 causes movement of upper slide 128 along upper shaft 118, is transferred through extendible member 114 to cause movement of lower slide 130 along lower shaft 122.

Extendible member 114 has a lower support tube 148 disposed at 90° to lower shaft 122 and connected at its lower TM end to lower slide 130 through a plate 150. A plate 152 is connected to support tube 148 at its upper end. An extension member 154 is slidably disposed within the hollow interior of lower support tube 148 and is axially movable relative thereto. A pair of spaced bearing assemblies 155, 156 are provided in the interior of lower support tube 148 adjacent extension member 154, to provide smooth movement of extension member 154 relative to lower support tube 148. Extension member 154 is connected at its upper end to a mounting bracket 158. A pin 160 is inserted through an opening provided in mounting bracket 158 for connecting mounting bracket 158 to the lower end of bar 134. Extension member 154 is free to axially move relative to lower support tube 148 during extension or retraction of lift cylinder 38 or boom cylinder 40 to accommodate any movement of the boom sections.

In operation, first the boom sections are raised, lowered, and extended or retracted so as to appropriately position fork tines 34 at the desired elevation relative to main frame assembly 12. When it is thereafter desired to move fork tines 34 toward or away from main frame assembly 12 at a constant elevation relative thereto, a button provided at the end of control lever 45 (FIG. 1) is depressed. Depression of the button on control lever 45 actuates clamping mechanism 115, as will subsequently be explained. Such actuation of clamping mechanism 115 maintains fork tines 34 at a constant elevation relative to main frame assembly 12 while moving fork tines 34 toward and away therefrom during retraction or extension of boom cylinder 40.

Figure 8:
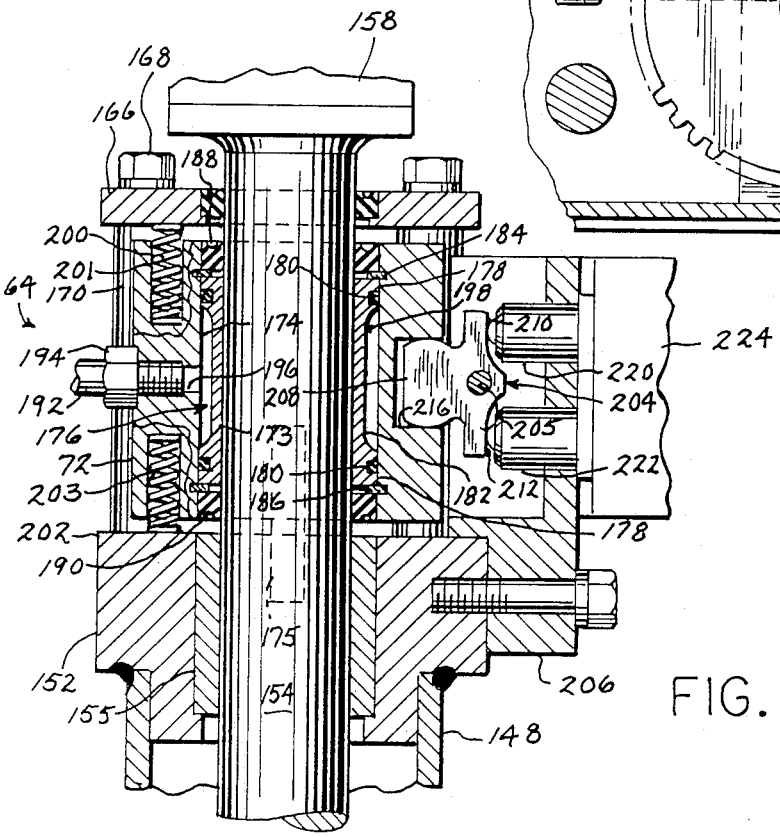
FIG. 8 is a detailed sectional view generally showing the components of FIG. 7 in an assembled relation.

As shown in FIG. 6, clamping mechanism 115 is connected to plate 152 at the upper end of lower support tube 148. Upon depression of the button on control lever 45, clamping mechanism 115 clamps onto extension portion 154. As shown in FIG. 8, clamping mechanism 115 is disposed between plate 152 and an upper plate 166 fixedly connected to plate 152 by means of a plurality of bolts 168 connected through sleeve spacer members 170. Clamping mechanism 115 generally includes a tubular housing 172 which has an axial passage defined by an inner wall 174 for accommodating passage of extension member 154 therethrough. A pair of dowels, shown at 175, are provided in openings in plate 152 and in the underside of housing 172 to maintain a constant rotational position of housing 172 relative to plate 152. A sleeve member 176 is provided within the axial passage through housing 172, and includes an inner surface 173 in close proximity with extension portion 154. Sleeve member 176 includes annular end portions 178 which are provided with O-ring seals 180. An area of reduced diameter is disposed between end portions 178 to define a relatively thin walled portion 182. Sleeve 176 is held in place within the passage through housing 172 by means of upper and lower snap rings 184 and 186, respectively, provided within grooves formed in inner wall 174 of housing 172. Upper and lower wipers 188, 190 are provided above and below upper and lower snap rings 184, 186, respectively, to wipe excess oil, dirt or other debris from extension portion 154 during its passage through housing 172.

A hydraulic fluid line 192 is connected to housing 172 via a fitting 194 provided in a port 196 formed in the wall of housing 172. The reduced diameter portion of sleeve member 176, in combination with inner wall 174 of housing 172, defines a fluid passage 198 in fluid communication with port 196. Hydraulic fluid passing through line 192 flows through port 196 and into fluid passage 198.

When the button on control lever 45 is depressed so as to actuate clamping mechanism 115, hydraulic fluid under pressure is pumped into fluid passage 198 through hydraulic fluid line 192. Such hydraulic fluid is under considerable pressure, such as approximately 1600 psi, which is sufficient to deform thin walled portion 182 of sleeve member 176 inwardly so as to move inner surface 173 into frictional engagement with extension member 154. With this arrangement, housing 172 essentially becomes clamped onto extension member 154.

A series of upper springs, such as 200, are provided in spring passages, such as 201, formed in the upper end of housing 172 between housing 172 and upper plate 166. Likewise, a series of lower springs, such as 202, are provided in spring passages, such as 203, formed in the lower end of housing 172 between housing 172 and plate 152. Springs 200, 202 act to suspend housing 172 between plate 152 and upper plate 166.

During extension or retraction of the boom sections, drive gear 108 drives toothed rack 142 so as to move upper slide member 110 along upper shaft 118. Such movement is transferred to extendible member 114 so as to move extendible member 114 substantially horizontally along lower shaft 122. When upper shaft 118 is disposed at an angle relative to lower shaft 122, i.e., when the boom sections are either above horizontal or below horizontal, the horizontal movement of extendible member 114 caused by movement of toothed rack 142 will tend to either compress or elongate extendible member 114. . The tendency of extendible member 114 to compress or elongate is reflected in either a downward or upward movement of housing 172 of clamping mechanism 115 within the space between plate 152 and upper plate 166. That is, when clamping mechanism 115 is actuated and the boom sections are retracted or extended, thus causing movement of drive mechanism 142, housing 172 of clamping mechanism 115 will move upwardly or downwardly against the bias of springs 200 or 202 so as to indicate the tendency of extendible member 114 to compress or elongate.

It should be understood that, when clamping mechanism 115 is not actuated, extension portion 154 freely moves relative to lower support tube 148. Such movement of extension portion 154 can be caused by extension or retraction of lift cylinders 38 resulting in angular movement of the boom sections, or by extension or retraction of boom cylinder 40 resulting in movement of rack 142 and upper and lower slides 128, 130.

A rocker arm assembly 204 is pivotably mounted at a pivot pin 205 provided in a mount assembly 206 connected to plate 152 at the upper end of lower support tube 148. Rocker arm assembly 204 comes into play upon actuation of clamping mechanism 115, and includes a sensing portion 208 and a pair of end portions 210, 212. Sensing portion 208 is mounted within a groove 216 formed in the outer surface of housing 172. When clamping mechanism 115 is actuated, upward and downward movement of housing 172 during extension or retraction of the boom sections results in upward and downward movement of sensing portion 208 of rocker arm assembly 204, which is translated into clockwise or counterclockwise movement of end portions 210, 212 about pivot pin 205. In this manner, the tendency of extendible member 114 to compress during horizontal movement along upper and lower shafts 118, 122 is reflected in downward movement of housing 172, which thus causes counterclockwise rotation of rocker arm assembly 204 about pivot pin 205. Similarly, the tendency of extendible member 114 to elongate results in clockwise rotation of rocker arm assembly 204.

End portions 210, 212 of rocker arm assembly 204 are mounted adjacent valve control plungers 220, 222 provided on a control valve 224 connected to mount assembly 206. As will be explained, control valve 224 is interconnected with the hydraulic circuitry controlling lift cylinders 38, so that actuation of plungers 220, 222 results in proportional fluid pressure being supplied to a lift control valve which supplies hydraulic fluid to either the rod end or cylinder end of lift cylinders 38. In this manner, the magnitude of the tendency of extendible member 114 to compress or elongate during retraction or extension of the boom sections is translated by rocker arm assembly 204 through valve control plungers 220, 222, and into hydraulic fluid pressure which is routed to a lift control valve which supplies hydraulic fluid to the appropriate end of lift cylinders 38 so as to extend or retract lift cylinders 38 an appropriate amount to maintain a constant elevation of fork tines 34 relative to main frame assembly 12 during extension or retraction of the boom sections. The described mechanism creates fluid pressure through control valve 224 in an amount proportional to the amount of movement of housing 176, to constantly maintain fork tines 34 level.

Springs 200, 202 center housing 176 between plates 152 and 166 and establish a "null point", from which the tendency of extendible member 114 to compress or elongate can be determined by rocker arm assembly 204. When clamping mechanism 115 is not actuated, springs 200, 202 establish a starting point to be used upon actuation of clamping mechanism 115 when level traverse is desired.

It should be noted that, under some operating conditions, it is necessary for clamping mechanism 115 to slip relative to extension portion 154. For example, when lift cylinders 38 are fully extended and the direction controlling mechanism is actuated so as to activate clamping mechanism 115, and it is then desired to retract boom cylinder 40, there is no amount of extension remaining in lift cylinders 38 to adjust the angle between the boom sections and the vehicle frame so as to maintain the load elevation. In this situation, there must be slippage between clamping mechanism 115 and extension portion 154 to prevent excessive stress and possibly breakage of the components of drive mechanism 116. The design of clamping mechanism 115 allows such slippage to occur without damage to clamping mechanism 115.

It should be understood that any satisfactory signal-generating mechanism may be used in place of hydraulic control valve 224. For example, the output signal in response to sensed movement of extension portion 154 could be in the form of air pressure or an electrical signal. The control valve for actuating lift cylinders 38 would then be responsive to the generated signal. Alternately, a lift control valve could be used in place of control valve 224, which would bypass lift control valve 232 as actuated by control valve 224.

The theory behind the operation of the direction controlling mechanism of the invention can be explained as follows. Boom pivot pin 30 serves as a common vertex for two similar triangles, one of which is formed by the load lifting components of forklift 10 and the other of which is formed by the direction controlling mechanism. Each triangle has a leg extending axially relative to large boom section 24 from boom pivot pin 30. A second leg of the load lifting triangle extends normally from the first leg to fork pivot pin 37, and the corresponding leg of the lift copy triangle extends normally from the first leg to pin 160 through mounting bracket 158. The third legs of the load lifting and lift copy triangles extend between fork pivot pin 37 and pin 160, respectively, and boom pivot pin 30. The two triangles are constantly maintained proportionally similar by the direction controlling mechanism of the invention by extending or retracting lift cylinders 38 during extension or retraction of boom members 24, 26 and 28. This action maintains the load elevation during such extension or retraction of boom members 24, 26 and 28.

It should also be understood that the described mechanism is not limited to an extendible/retractable boom structure. For example, the assembly as described could be replaced with a cylinder arrangement in which a cylinder shaft acts as extension member 154, and the cylinder housing acts as stationary member 148. Clamping mechanism 115, rocker arm assembly 204, and control valve 224 are eliminated. When it is desired to control the elevation of a point along the length of the two or more segments, the direction controlling mechanism is actuated and the head and base areas of the cylinder are hydraulically connected to end caps of a lift control valve. Extension/retraction of the cylinder arrangement would control the lift valve which in turn controls movement of the lift cylinders. The control of the the lift valve would be proportional to the extension/retraction of the cylinder arrangement.

To accommodate for boom deflection and tire deflection under load, upper shaft 118 is mounted 1 ½° below the axis of the boom sections. It has been found that this amount of offset maintains fork tines 34 at a substantially constant elevation relative to main frame assembly 12 during retraction or extension of the boom sections.

It should be appreciated that any desired direction of movement of a point along the length of a member mounted at an angle to boom sections 24, 26, 28 relative to main frame assembly 12 can be achieved by proper placement of upper shaft 112. That is, if a non-level extension or retraction of a certain point is desired, shaft 118 is simply oriented relative to the axis of the boom sections according to the desired direction of movement.

Figure 9A:
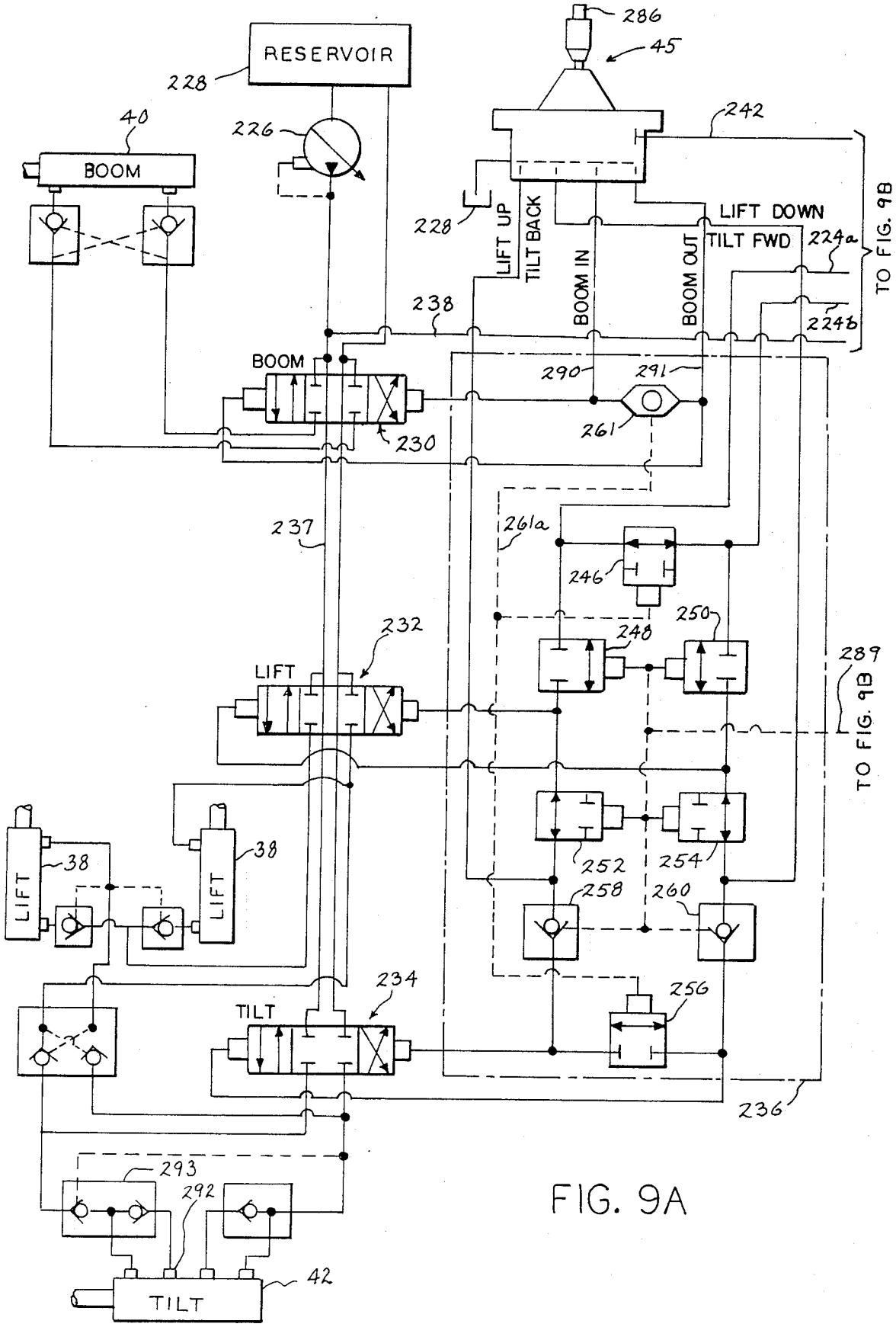
FIGS. 9A and 9B are schematic diagrams showing the hydraulic circuitry of the extendible boom forklift of the invention.
Figure 9B:
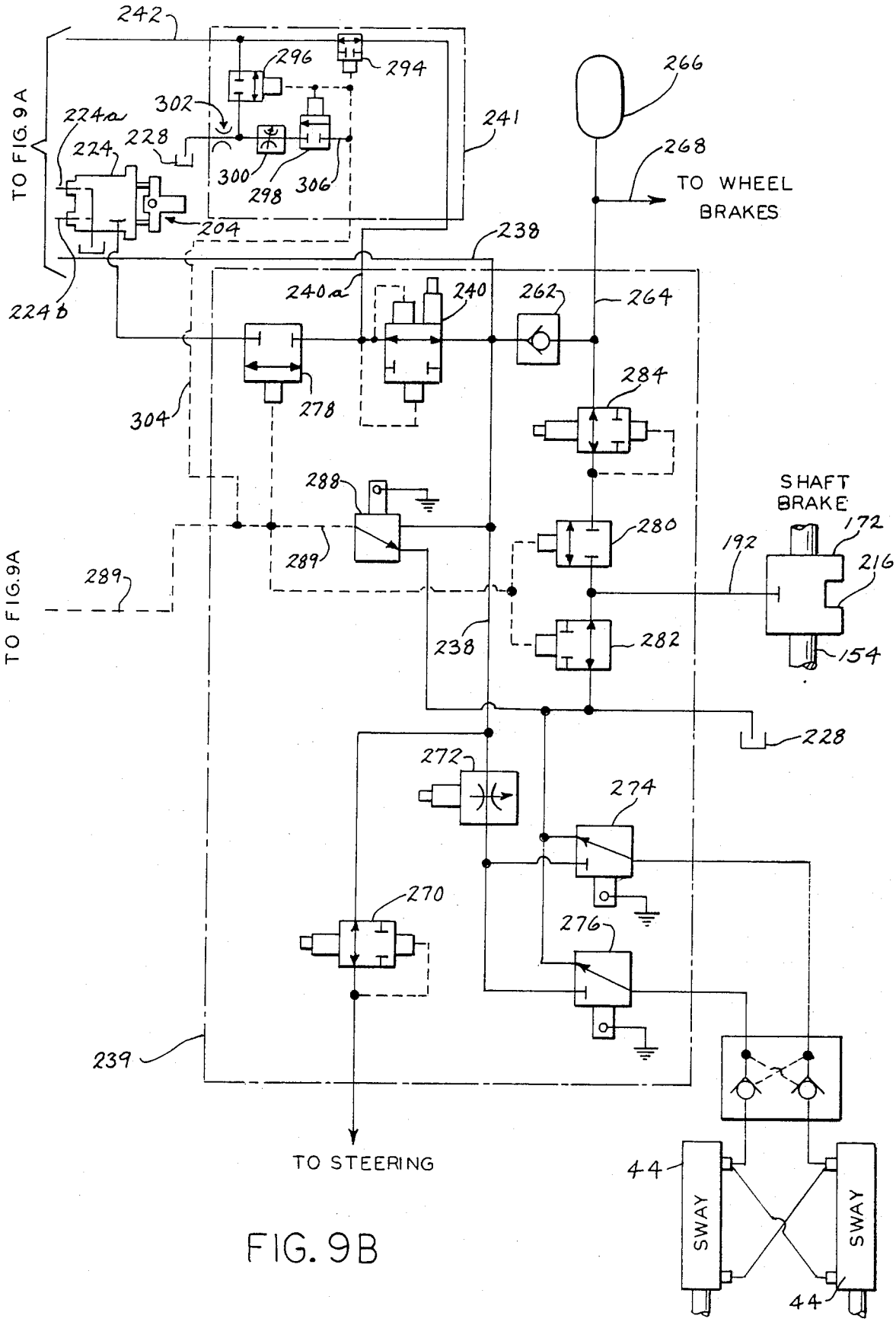

With reference to FIGS. 9A and 9B, the hydraulic circuitry for the hydraulic components utilized in connection with forklift 10 are supplied with hydraulic pressure by means of a pressure compensated hydraulic fluid pump 226 which draws hydraulic fluid from a fluid reservoir 228. A four way main control valve, including boom control section 230, lift control section 232, and tilt control section 234, receives hydraulic fluid under pressure from pump 226 through a line 237. Sections 230, 232 and 234 are each connected to a respective port formed in a logic block, represented by dashed line 236. A line 238 routes hydraulic fluid from line 237 to a control block, represented by dashed line 239. Within control block 239, hydraulic fluid is directed to a pressure reducing valve 240. From valve 240, fluid exits control block 239 via a line **240*a* and passes into a prioritizing block represented by dashed line 241, the operation of which will be explained. Fluid passes from prioritizing block 241 via a line 242 to control lever 45**.

Control lever 45 is movable in four directions, referred to as north, south, east and west and supplies proportional control pressure to valve control sections 230, 232 and 234, and therefore the operation of lift cylinders 38, boom cylinder 40 and tilt cylinder 42, for extending and retracting such cylinders during non-level traverse operation.

A series of pilot operated valves, shown at 246, 248, 250, 252, 254 and 256, are disposed within the interior of logic block 236. Additionally, a pair of pilot operated check valves 258, 260, and a shuttle valve 261, are also disposed within the interior of logic block 236. Valves 246–261 inclusive, are shown in their normal positions for controlling the flow of hydraulic fluid through logic block 236 under non-level traverse operation.

As to control block 239, hydraulic fluid is routed from line 238 through a check valve 262 to a line 264 which leads to a pressure accumulator 266. As is known, pressure accumulator 266 maintains a predetermined volume of hydraulic fluid at a constant high pressure. A line 268 leads to the wheel brakes (not shown) for supplying hydraulic pressure thereto from accumulator 266.

Shown at the lower end of control block 239 are a series of valves connected to line 238 for controlling the steering function and sway cylinders 44 associated with forklift 10. These valves include a pressure reducing valve 270 leading to the steering circuit, and a needle valve 272 operable in association with a pair of electric valves 274, 276 associated with the sway cylinder circuitry. Control block 239 also includes pilot operated valves 278, 280 and 282, and a pressure reducing valve 284. These valves control the flow of hydraulic fluid through control block 239.

When it is desired to actuate the direction controlling mechanism of the invention as described above, a button 286 provided on control lever 45 is depressed by the operator. This depression of button 286 triggers an electric valve 288 provided within the interior of control block 239. Actuation of electric valve 288 provides pilot pressure in pilot line 289 leading from electric valve 288, to reverse the normal dispositions of valves 278, 280 and 282 within control block 239, and of valves 248, 250, 252, 254, 258 and 260 within logic block 236. Thus, the depression of button 286 and the actuation of electric valve 288 essentially creates an additional set of hydraulic control flow paths during movement of control lever 45 when button 286 is depressed. That is, an entirely new flow path for hydraulic fluid through blocks 236 and 239 is formed upon depression of button 286.

When button 286 is depressed, hydraulic fluid flow is directed from valve 284 through valve 280 and into line 192 connected to housing 172 of clamping mechanism 115 so as to actuate clamping mechanism 115. Simultaneously, fluid passes from line 238 through valves 240 and 278 into control valve 224. This supply of fluid to control valve 224 places control valve 224 at the ready, so that any movement sensed by rocker arm assembly 204 and transferred to plungers 220, 222 is automatically translated into hydraulic fluid pressure by plungers 220, 222. Fluid pressure from plungers 220, 222 passes from control valve 224 and through either valve 248 or 250 and into lift control valve 232, and ultimately into lift cylinders 38 to extend or retract lift cylinders 38 and compensate for upward or downward movement of housing 172 during extension or retraction of the boom members.

During depression of button 286 and movement of control lever 45 so as to direct fluid into either of lines 290 or 291 for extending or retracting boom cylinder 40, shuttle valve 261 will sense any pressure differential between lines 290 and 291 and introduce pressure in the higher amount into pilot line **261*a*. Such pressure in pilot line 261*a* reverses the disposition of valves 256 and 246. In this manner, fluid pressure from control valve 224 is allowed to pass through lift control valve 232 and into lift cylinder 38. Valve 246 allows pressure to build up in control valve 224 upon depression of button 286 and, upon release of button 286, immediately releases pressure in control valve 224 to immediately cut off the supply of fluid to lift cylinders 38. This prevents movement of lift cylinders 38 at the end of level traverse; otherwise, lift cylinders 38 would tend to compensate for any remaining error sensed by rocker arm assembly 224** to thereby cause a "dip" at the end of level traverse.

With the hydraulic circuitry as described, when button 286 on control lever 45 is depressed, control lever 45 cannot be used to control the lift cylinders. Rather, movement of the lift cylinders is exclusively controlled by control valve 224 in response to movement sensed by rocker arm 204. However, control lever 45 can be used to manipulate tilt cylinder 42 according to the circuitry described when button 286 is depressed.

A feature incorporated in connection with tilt cylinder 42 allows tilt cylinder 42, which is connected in series with a lift cylinder 38 so as to maintain fork tines 34 level during extension or retraction of lift cylinders 38, to be maintained in a position of full extension even when additional extension remains in lift cylinders 38. That is, when tilt cylinder 42 is fully extended and there is some amount of extension remaining in lift cylinders 38, lift cylinders 38 may be extended the remaining amount, and are not limited by tilt cylinder 42 being fully extended. When tilt cylinder 42 is bottomed out so that it can extend no more, a port 292 is opened so as to allow additional fluid entering the base of tilt cylinder 42 to pass therethrough out of tilt cylinder 42 and through a check valve 293 connected therewith. In this manner, tilt cylinder 42 essentially becomes a valve in itself so as to allow fluid flow therethrough to accommodate additional extension of lift cylinder 38.

As noted previously, fluid passes through prioritizing block 241 prior to its entry into control lever 45. Prioritizing block 241 is provided with pilot operated valves 294 and 296, a pilot operated relief valve 298, an adjustable orifice needle valve 300, and a fixed orifice needle valve 302. A pilot line 304 supplies pilot pressure to valves 294, 296 and 298 from pilot line 289 when button 286 is depressed.

During non-level traverse operation, hydraulic fluid passes from line **240*a* and into block 241. Fluid then passes through valve 294 and into line 242 for supply to control lever 45. When button 286 is depressed, pilot pressure from line 304 reverses the normal disposition of valves 294 and 296. Flow is then cut off through valve 294, and is routed via a line 306 to relief valve 298. Relief valve 298 holds back a predetermined amount of pressure from valves 300 and 296 to control the amount of fluid pressure in line 242, and which is thus available to extend or retract boom cylinder 40. The pressure in line 242 is also controlled by restrictions in needle valves 300 and 302**.

By its design, pump 226 maintains a predetermined pressure in the hydraulic circuit. This pressure is supplied via line 237 to the boom (230), lift (232) and tilt (234) control sections of the main control valve. With the interposition of prioritizing block 241 between pump 226 and control lever 45 when button 286 is depressed, pressure is reduced proportional to pump pressure in line 304 and passes through line 242 to control lever 45. With the described construction of prioritizing block 241, the pressure supplied to control lever 45 through line 242 varies with the pressure coming into block 241 through line 304. Whe pump pressure drops, such as in response to inability of pump 226 to meet the flow demand in the hydraulic circuit as governed by control lever 45, then the pressure supplied to control lever 45 through line 242 will likewise drop. If incoming pressure to prioritizing block 41 falls below the predetermined pressure held back by relief valve 298, then there will be no pressure available to control lever 45 for extending or retracting boom cylinder 40. As incoming pressure to prioritizing block 241 rises above the threshold set by relief valve 298, such pressure becomes available to control lever 45 for extending or retracting boom cylinder 40.

Prioritizing block 41 essentially selects the order of priority in which hydraulic pressure is supplied to two or more control elements in a hydraulic circuit. Due to the presence of relief valve 298, a predetermined amount of pressure is always available to lift cylinders 38. This ensures that, whenever button 286 is depressed and boom cylinder 40 extended or retracted, sufficient pressure is available to extend or retract lift cylinders 38 to maintain level traverse.

The ability or inability of pump 226 to keep up with the flow demand in the hydraulic circuit varies according to engine speed. That is, as engine speed increases or decreases and pump flow fails to meet the flow demand of the circuit, the incoming pressure to prioritizing block 241 also increases or decreases, and the pressure output in line 242 increases or decreases proportionally. The rate of extension of boom cylinder 40 when button 286 is depressed is thus sensitive to engine speed, thereby increasing the amount of speed control which the operator can exercise over the level traverse extension or retraction of a load.

Various alternatives and modifications are contemplated as being within the scope of the following claims particularly pointing out and distinctly claiming the invention.

I claim:

1. An apparatus, comprising:

a vehicle frame;

two or more elongated members mounted to said frame, said members having a proximal end adjacent the mounting of said two or more members to said frame and a distal end spaced therefrom, one of said members being movable toward and away from said frame;

an upper shaft mounted to said two or more members adjacent the proximal end thereof;

a lower shaft mounted to said vehicle frame; and a direction controlling apparatus including control means operative between said upper and lower shafts for maintaining a constant direction of movement of a predetermined point along the length of said two or more members relative to said vehicle frame during movement of said movable member toward and away from said frame, said control means comprising;

an extendible member movably mounted at its ends to said upper and lower shafts and including a first portion and an extendible second portion;

clamping means associated with the first portion of said extendible member for selectively clamping said second extendible portion of said extendible member;

drive means for moving said extendible member linearly along said upper and lower shafts after actuation of said clamping means during movement of said movable member toward and away from said vehicle frame, said drive means moving said extendible member along said shafts in an amount proportional to the movement of said movable member so that, when said upper and lower shafts are nonparallel, said movement of said extendible member therealong tends to compress or elongate said extendible member; and adjustment means responsive to the tendency of said extendible member to compress or elongate during movement of said movable member, for adjusting the angle between the proximal end of said two or more members and said vehicle frame, and thereby between said upper shaft and said lower shaft, during movement of said movable member toward and away from said vehicle frame.

2. A direction controlling apparatus for an extendible boom forklift or the like including a vehicle frame having two or more elongate members mounted thereto, said two or more members having a proximal end adjacent the mounting of said members to said frame and a distal end spaced therefrom, with one of said members being movable toward and away from said frame, said direction controlling apparatus controlling the direction of movement of a predetermined point along the length of said members during movement of the movable member toward and away from said frame, and comprising:

an upper shaft mounted to said two or more members adjacent the proximal end thereof;

a lower shaft mounted to said vehicle frame; and control means operative between said upper and lower shafts for maintaining a constant direction of movement of said predetermined point along the length of said two or more members relative to said vehicle frame during movement of said movable member toward and away from said frame, wherein said control means comprises:

an extendible member movably mounted at its ends to said upper and lower shafts and including a first portion and an extendible second portion;

clamping means associated with the first portion of said extendible member for selectively clamping said second extendible portion of said extendible member;

drive means for moving said extendible member linearly along said upper and lower shafts after actuation of said clamping means during movement of said movable member toward and away from said vehicle frame, said drive means moving said extendible member along said shafts in an amount proportional to the movement of said movable member so that, when said upper and lower shafts are non-parallel, said movement of said extendible member therealong tends to compress or elongate said extendible member; and adjustment means responsive to the tendency of said extendible member to compress or elongate during movement of said movable member, for adjusting the angle between the proximal end of said two or more members and said vehicle frame, and thereby between said upper shaft and said lower shaft, during movement of said movable member toward and away from said vehicle frame.

3. The direction controlling apparatus of claim 2, wherein said two or more elongated members comprise boom members which are extendible and retractable toward and away from said vehicle frame.

4. The direction controlling apparatus of claim 3, wherein said control means comprises levelling means for maintaining a constant elevation of said distal end of said one or more boom members relative to said vehicle frame during retraction or extension of said one or more boom members.

5. The direction controlling apparatus of claim 2, wherein said clamping means for selectively clamping said second extendible portion of said extendible member comprises:

housing means mounted to said first portion and accommodating passage of said extendible second portion therethrough;

sleeve means disposed within said housing means and having a passage therethrough including an inner surface in close proximity with an outer surface of said extendible second portion, said sleeve means having a relatively thin walled portion adjacent its inner surface; and fluid passage means disposed adjacent said thin walled portion of said sleeve means, said fluid passage means being adapted to receive fluid under sufficient pressure to deform said thin walled portion of said sleeve means so as to cause said inner surface of said sleeve means to frictionally engage an outer surface of said second extendible portion of said extendible member.

6. The direction controlling apparatus of claim 5, wherein said first portion of said extendible member comprises a tubular shaft having an internal passage, and wherein said second extendible portion is telescopically disposed relative to said first portion so as to be axially movable relative to said tubular shaft within the internal passage of said tubular shaft.

7. The direction controlling apparatus of claim 6, wherein said housing means is mounted to said tubular shaft adjacent its upper end.

8. The direction controlling apparatus of claim 5, wherein said fluid passage means comprises an area of reduced diameter formed in said sleeve means adjacent said thin walled portion of said sleeve means.

9. The direction controlling apparatus of claim 5, wherein said housing means is mounted to said first portion so as to allow a small amount of movement of said second extendible portion relative to said first portion in order to indicate the tendency of said extendible member to compress or elongate during movement of said extendible member along said upper and lower shafts.

10. The direction controlling apparatus of claim 9, wherein said housing means is mounted between a pair of spaced plates connected to said first portion, said housing means extending less than the full height of the spacing between said plates, and further comprising resilient means disposed between said housing means and said plates for accommodating said small amount of movement between said second extendible portion and said first portion.

11. The direction controlling apparatus of claim 10, wherein said resilient means comprises spring means disposed between said housing means and said spaced plates, said spring means acting to suspend said housing means between said spaced plates.

12. The direction controlling apparatus of claim 2, wherein, after actuation of said clamping means for clamping said second extendible portion of said extendible member, a small amount of bidirectional axial movement of said second extendible portion is allowed in order to indicate the tendency of said extendible member to compress or elongate during movement of said extendible member along said upper and lower shafts, and wherein said adjustment means is responsive to said small amount of movement to adjust the angle between said upper shaft and said lower shaft.

13. The direction controlling apparatus of claim 12, wherein said adjustment means comprises:

sensing means for sensing the bidirectional axial movement of said second extendible portion of said extendible member during movement of said extendible member; and elevation control means responsive to said sensing means for adjusting the angle between said upper shaft and said lower shaft for controlling the elevation of said predetermined point on said two or more elongated members relative to said vehicle frame during movement of said movable member toward and away therefrom.

14. The direction controlling apparatus of claim 13, wherein said elevation control means includes one or more hydraulic cylinders for effecting movement of said two or more elongated members during movement of said movable member toward and away from said vehicle frame for adjusting the angle between said upper shaft and said lower shaft to control the direction of movement of said predetermined point along the length of said two or more elongated members, and wherein said elevation control means controls the movement of one or more hydraulic cylinders during movement of said movable member.

15. The direction controlling apparatus of claim 14, wherein said elevation control means comprises a control valve for regulating extension or retraction of said one or more hydraulic cylinders proportional to the movement of said movable member to provide said constant direction of movement of said predetermined point along the length of said two or more elongated members relative to said vehicle frame.

16. The direction controlling apparatus of claim 15, wherein said sensing means is interconnected with said second extendible portion of said extendible member so as to be sensitive to bidirectional axial movement thereof, said sensing means including actuator means for actuating said control valve responsive to bidirectional movement of said second extendible portion of said extendible member to effect extension or retraction of said one or more hydraulic cylinders.

17. The direction controlling apparatus of claim 16, wherein said actuator means comprises a pivotable rocker arm, said rocker arm including end portions which are movable toward and away from said control valve in response to movement of said second extendible portion of said extendible member for selectively actuating valve control elements provided on said control valve adjacent said end portions of said rocker arm, to thereby control retraction and extension of said one or more hydraulic cylinders in response to movement of said second extendible portion of said extendible member.

18. The direction controlling apparatus of claim 2, wherein said drive means for moving said extendible member along said upper and lower shafts is driven responsive to movement of said movable member toward and away from said vehicle frame.

19. The direction controlling apparatus of claim 18, wherein said drive means includes a rotatable gear rotatable in response to movement of said movable member.

20. The direction controlling apparatus of claim 19, wherein the upper end of said extendible member is slidably mounted to said upper shaft by means of an upper slide member, and wherein said drive means comprises a toothed rack connected to said upper slide member and engageable with said rotatable gear and axially movable in response to rotation of said rotatable gear, so that, upon rotation of said rotatable gear, said toothed rack is caused to move axially and to thereby cause movement of said upper slide member along said upper shaft.

21. The direction controlling apparatus of claim 20, wherein the upper end of said extendible member is pivotably connected to said upper slide member.

* * * * *